US008532823B2

(12) United States Patent
McElroy et al.

(10) Patent No.: US 8,532,823 B2
(45) Date of Patent: Sep. 10, 2013

(54) DISRUPTOR GUIDANCE SYSTEM AND METHODS BASED ON SCATTER IMAGING

(75) Inventors: Terry McElroy, Arlington, MA (US); Jim Pascoe, Northborough, MA (US)

(73) Assignee: American Science and Engineering, Inc., Billerica, MA (US)

( * ) Notice: Subject to any disclaimer, the term of this patent is extended or adjusted under 35 U.S.C. 154(b) by 425 days.

(21) Appl. No.: 13/017,197

(22) Filed: Jan. 31, 2011

(65) Prior Publication Data

US 2012/0221144 A1 Aug. 30, 2012

Related U.S. Application Data

(60) Provisional application No. 61/304,046, filed on Feb. 12, 2010, provisional application No. 61/314,336, filed on Mar. 16, 2010.

(51) Int. Cl.
*G05B 15/00* (2006.01)
*G06F 19/00* (2011.01)

(52) U.S. Cl.
USPC ..... 700/259; 700/245

(58) Field of Classification Search
USPC ..... 700/245, 259; 901/1, 2, 4, 5, 14; 340/539.1, 539.13, 572.2; 348/143, 152; 102/351, 357, 403, 439, 475, 504, 505; 342/13, 342/22, 27, 90
See application file for complete search history.

(56) References Cited

U.S. PATENT DOCUMENTS

| | | | | |
|---|---|---|---|---|
| 3,569,708 | A | 3/1971 | Weinbaum et al. | 250/83.3 |
| 3,868,506 | A | 2/1975 | Ogiso | 250/278 |
| RE28,544 | E | 9/1975 | Stein et al. | 250/369 |
| 3,928,765 | A | 12/1975 | Teller | 250/272 |
| 4,047,029 | A | 9/1977 | Allport | 250/273 |
| 4,052,617 | A | 10/1977 | Garrett et al. | 250/360 |
| 4,342,914 | A | 8/1982 | Bjorkholm | 378/99 |
| 4,458,152 | A | 7/1984 | Bonora | 250/353 |
| 4,768,214 | A | 8/1988 | Bjorkholm | 378/87 |
| 4,799,247 | A | 1/1989 | Annis et al. | 378/87 |
| 4,864,142 | A | 9/1989 | Gomberg | 250/390.04 |
| 4,884,289 | A | 11/1989 | Glockmann et al. | 378/57 |
| 4,974,247 | A | 11/1990 | Friddell | 378/90 |
| 5,002,397 | A | 3/1991 | Ingrum et al. | 356/407 |

(Continued)

FOREIGN PATENT DOCUMENTS

WO WO 00/33060 6/2000

OTHER PUBLICATIONS

International Searching Authority, International Search Report—International Application No. PCT/US 11/23143, dated Nov. 25, 2011, together with the Written Opinion of the International Searching Authority, 12 pages.

*Primary Examiner* — Ian Jen
(74) *Attorney, Agent, or Firm* — Sunstein Kann Murph & Timbers LLP

(57) ABSTRACT

A system and method for guiding a disruptor robot in disruption of an explosive device. The system includes a source of penetrating radiation, having a coordinated position on the robot with respect to a disrupter coupled to robot, and at least one detector for detecting radiation produced by the source and scattered by the explosive device. An analyzer produces an image of the explosive device and facilitates identification of a disruption target of the explosive device. A controller positions the disruptor with respect to the explosive device so that the disruptor is aimed at the disruption target.

13 Claims, 4 Drawing Sheets

(56) References Cited

U.S. PATENT DOCUMENTS

| | | | | |
|---|---|---|---|---|
| 5,014,293 | A | 5/1991 | Boyd et al. | 378/197 |
| 5,022,062 | A | 6/1991 | Annis | 378/86 |
| 5,065,418 | A | 11/1991 | Bermbach et al. | 378/57 |
| 5,091,924 | A | 2/1992 | Bermbach et al. | 378/57 |
| 5,132,995 | A | 7/1992 | Stein | 378/56 |
| 5,179,581 | A | 1/1993 | Annis | 378/57 |
| 5,181,234 | A | 1/1993 | Smith | 378/87 |
| 5,224,144 | A | 6/1993 | Annis | 378/146 |
| 5,253,283 | A | 10/1993 | Annis et al. | 378/100 |
| 5,302,817 | A | 4/1994 | Yokota et al. | 250/214 VT |
| 5,313,511 | A | 5/1994 | Annis et al. | 378/87 |
| 5,349,191 | A | 9/1994 | Rogers | 250/367 |
| 5,391,879 | A | 2/1995 | Tran et al. | 250/367 |
| 5,591,462 | A | 1/1997 | Darling et al. | 425/173 |
| 5,629,966 | A | 5/1997 | Dykster et al. | 378/57 |
| 5,638,420 | A | 6/1997 | Armistead | 378/57 |
| 5,692,028 | A | 11/1997 | Geus et al. | 378/57 |
| 5,692,029 | A | 11/1997 | Husseiny et al. | 378/88 |
| 5,764,683 | A | 6/1998 | Swift et al. | 378/57 |
| 5,838,759 | A | 11/1998 | Armistead | 378/57 |
| 5,903,623 | A | 5/1999 | Swift et al. | 378/57 |
| 5,940,468 | A | 8/1999 | Huang et al. | 378/57 |
| 6,067,344 | A | 5/2000 | Grodzins et al. | 378/117 |
| 6,094,472 | A | 7/2000 | Smith | 378/86 |
| 6,249,567 | B1 | 6/2001 | Rothschild et al. | 378/88 |
| 6,252,929 | B1 | 6/2001 | Swift et al. | 378/57 |
| 6,269,142 | B1 | 7/2001 | Smith | 378/57 |
| 6,292,533 | B1 | 9/2001 | Swift et al. | 378/57 |
| 6,424,695 | B1 | 7/2002 | Grodzins et al. | 378/87 |
| 6,727,506 | B2 | 4/2004 | Mallette | 250/394 |
| 7,099,434 | B2 | 8/2006 | Adams et al. | 378/57 |
| 7,218,704 | B1 | 5/2007 | Adams et al. | 378/57 |
| 7,505,556 | B2 | 3/2009 | Chalmers et al. | 378/57 |
| 7,511,654 | B1 * | 3/2009 | Goldman et al. | 342/22 |
| 7,926,598 | B2 * | 4/2011 | Rudakevych | 180/9.32 |
| 8,074,752 | B2 * | 12/2011 | Rudakevych | 180/9.32 |
| 2002/0185612 | A1 | 12/2002 | Chalmers et al. | 250/492.1 |
| 2003/0016790 | A1 | 1/2003 | Grodzins et al. | 378/147 |
| 2004/0218714 | A1 | 11/2004 | Faust | 378/53 |
| 2008/0099692 | A1 | 5/2008 | Poreira et al. | 250/393 |
| 2009/0188379 | A1 | 7/2009 | Hiza et al. | 86/50 |
| 2009/0314554 | A1 * | 12/2009 | Couture et al. | 180/8.7 |
| 2010/0061509 | A1 * | 3/2010 | D'Ambrosio et al. | 378/62 |

* cited by examiner

DISRUPTOR GUIDANCE SYSTEM AND METHODS BASED ON SCATTER IMAGING

This application claims priority from U.S. provisional patent application Ser. No. 61/304,046, filed Feb. 12, 2010, and entitled, "Disruptor Guidance System and Methods Based on Scatter Imaging." This application also claims priority from U.S. provisional patent application Ser. No. 61/314,336, filed Mar. 16, 2010, and also entitled "Disruptor Guidance System and Methods Based on Scatter Imaging." Each of these applications is hereby incorporated by reference herein in its entirety.

TECHNICAL FIELD

The present invention relates to operating an explosive device disruptor, and, more particularly, to using a penetrating radiation imaging system to direct operation of the disruptor.

BACKGROUND ART

Disarming an explosive device such as an improvised explosive device (IED) requires careful analysis of the device and an identification of various components of the device such as a power source, trigger mechanisms, explosive materials, and wiring connections. An explosive ordnance disposal (EOD) technician generally examines such a device in order to identify the components of the device that may be disarmed without detonating the device. The technician proceeds to disrupt the device by accurately targeting an identified component and then destroying that component to render the device safe.

Difficulties arise in this process due to the fact that the internal components of such a device may not be visible without physical manipulation of the device or without moving or removing various components of the device. Accordingly, resolving the type and amount of explosives involved and confirming how the device is wired and where the trigger mechanism or mechanisms are located at a level of accuracy that allows a technician to safely disarm the explosive devices with a tactical robot often proves challenging.

SUMMARY OF EMBODIMENTS OF THE INVENTION

A first embodiment of the invention provides a system for guiding a disruptor robot in disruption of an explosive device. The system includes a source of penetrating radiation, having a coordinated position on the robot with respect to a disruptor coupled to the robot, at least one detector for detecting radiation produced by the source and scattered by the explosive device, an analyzer for producing an image of the explosive device including a disruption target of the explosive device, and a controller for positioning the disruptor with respect to the explosive device so that the disruptor is aimed at the disruption target. Positioning the disruptor may include positioning the robot. The radiation may be x-ray radiation, and the radiation scattered by the explosive device may include backscattered radiation. The image may be a 3-dimensional image.

In a related embodiment, the source may include a collimator adapted to collimate the penetrating radiation into a pencil beam of penetrating radiation. The source may also include a scanner adapted to displace the pencil beam of penetrating radiation.

Another embodiment of the present invention provides a guided system for the disruption of an explosive device. The system includes a mobile robot, a disruptor coupled to the robot, an imaging system coupled to the robot in coordination with the disruptor, and a controller for positioning the disruptor with respect to the explosive device. The imaging system includes a source of penetrating radiation having a coordinated position on the robot with respect to the disruptor, at least one detector for detecting radiation produced by the source and scattered by the explosive device, and an analyzer for producing an image of the explosive device including a disruption target of the explosive device. The controller positions the disrupter with respect to the explosive device so that the disruptor is aimed at the disruption target. Positioning the disruptor may include positioning the robot.

Yet another embodiment of the present invention provides a method of guiding a disruptor robot in disruption of an explosive device. The method includes inspecting the explosive with an inspection system coupled to the robot in coordination with a disruptor. The inspection includes irradiating the explosive device with radiation produced by a source of the inspection system, detecting, with at least one detector of the inspection system, radiation produced by the source and scattered by the explosive device, generating detector output signals based on radiation received by the at least one detector, and characterizing the explosive device on the basis of the detector output signals. The method further includes identifying a disruption target of the explosive device based on the characterization of the explosive device and positioning the disruptor of the robot with respect to the explosive device so that the disruptor is aimed at the disruption target. Irradiating the explosive device may include scanning the radiation source across the explosive device. Characterizing the explosive device may include creating an image of the explosive device on the basis of the detector output signals. Positioning the disruptor may include positioning the robot.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1A:
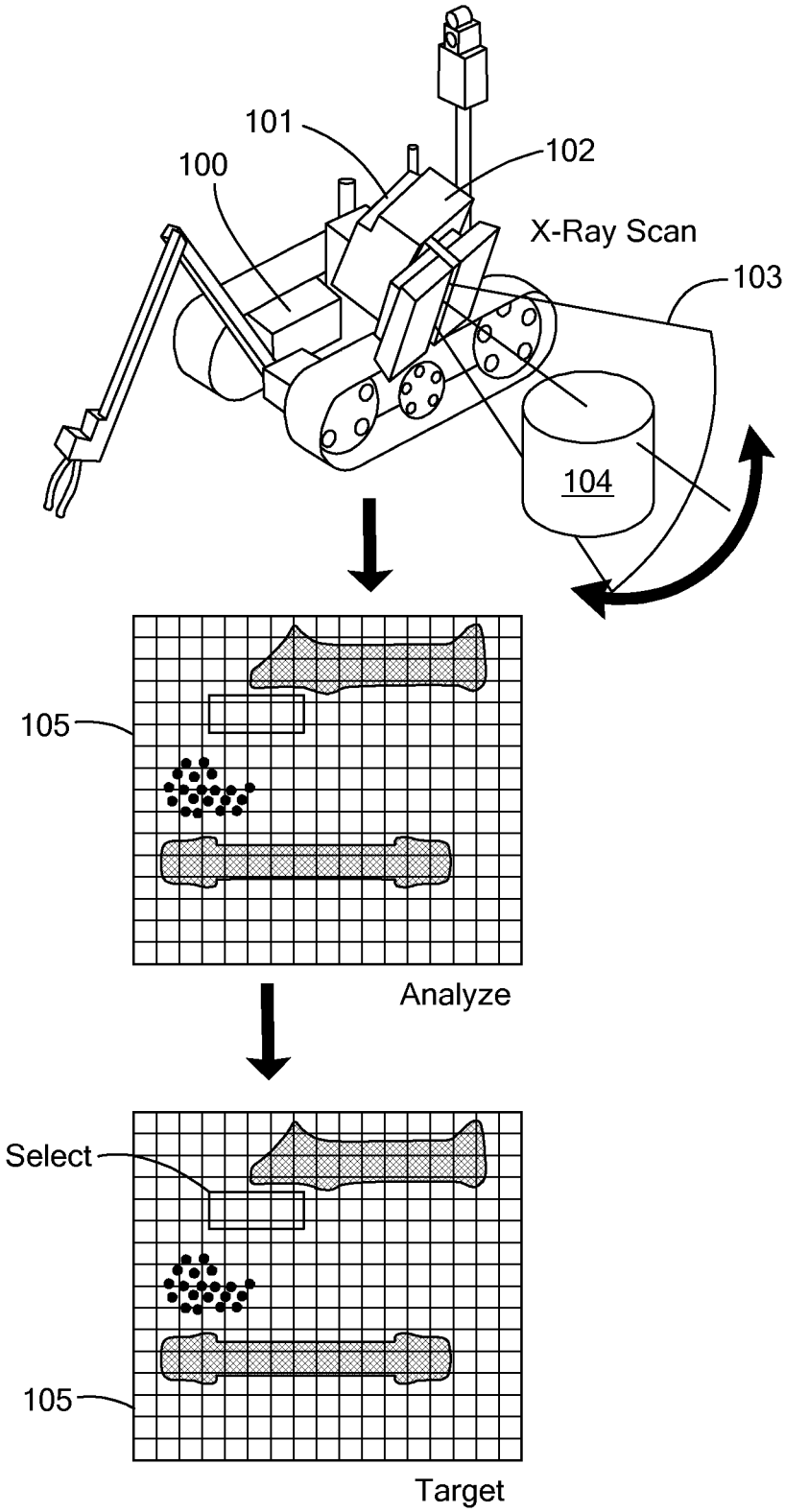
FIG. 1 illustrates an operational sequence engaged in by a robot to disrupt an explosive device in accordance with an embodiment of the present invention.

The use of penetrating radiation scattered from beneath the surface of an object in order to image features of the object is practiced in security inspection and in other industries. A description of x-rays, used in this context, by way of example, may be found in U.S. Pat. No. 7,099,434, which is incorporated herein by reference.

An operational sequence in which a robot disrupts an explosive device in an object, in accordance with an embodiment of the present invention, is now described with reference to FIG. 1. A robot in accordance with embodiments of the present invention may be a vehicular robot, an aerial robot, an aquatic robot or a robot achieving mobility in other forms including, but not limited to, walking, climbing, crawling, or rolling. An example of a tactical robot that may be employed in accordance with the present invention is the Talon® military robot sold by Foster-Miller, Inc. of Waltham, Mass. Once an object has been identified, visually or otherwise, as potentially containing an explosive device, mobile robotic device 100 may be used to approach object 104 at a distance sufficient to inspect object 104. The maximum inspection distance may be a function of the power and range of the radiation source and detector(s) of inspection system 102 located on robot 100. Once robot 100 is in a sufficient range for operation of inspection system 102 located thereon, the operational sequence for disruption targeting may be commenced.

In a first step, inspection system 102 irradiates the object with penetrating radiation 103. "Penetrating radiation" refers to radiation, typically high-energy electromagnetic radiation, such as x-rays or gamma rays, that propagates to an appreciable distance in a solid material. The penetrating radiation may be formed into a pencil beam, and may be scanned, using any of the scanning methods known in the art, to cover a portion of the object. Scattering of the penetrating radiation by structure internal to the object is then detected, and formed into image 105, to facilitate determination of the structure and/or composition of one or more devices located therein. The electromagnetic radiation may be x-ray radiation, but may be other forms of penetrating radiation suitable for characterizing explosive devices with enough detail to allow identification of a target for disruption without detonation. The electromagnetic radiation may be scanned across the object in a scanning pattern determined to achieve partial, or complete, irradiation of the object. The scanning pattern may include scanning a beam of penetrating radiation produced by a source of the inspection system in both horizontal and vertical directions. Inspection system 102 may be used to scan the object from multiple sides. An operator may remotely control robot 100 to achieve the scan or robot 100 may be programmed to scan object 104 automatically. Features of the object, including an identified disruption target may be characterized, either by the operator alone, or assisted by software programs, as to dimensional, or material, characteristics. For example, materials of high atomic number, such as wires, may be distinguished from typically lower atomic number materials such as explosives, based on their scatter image or images.

As inspection system 102 scans object 104. One or more detectors of the inspection system detects the radiation scattered by the object. The detectors will generate detector signals in response to detection of the scattered radiation and the detector signal generated will be used to characterize object 104. The characterization may be in the form of an image 105 and may identify other physical properties such as density or material composition of device components, in addition to the structural and dimensional properties of the device components.

The backscatter detected by the inspection systems may provide photo-like representation of the interior of a suspected IED without the need to access the far side of the object. Furthermore, the image information gathered by the detectors of the inspection system may be analyzed using the same control unit that is used to operate the robot and the disrupter via the radio interface. The robot and the inspection system may have a single power system.

Once the inspection system characterizes the object, the components of the device or devices within the object may be remotely analyzed based on the characterization. Properly positioning the disruptor or aiming the disruptor may include positioning the disruptor based on the location of a pencil beam 107 produced by inspection system 102. Accordingly, the disruptor bore may be co-located with a location of the x-ray pencil beam for disruption of the target. Disruption of the target may include physical destruction of the identified target by a projectile 110 propelled by disruptor 101. A disruptor in accordance with various embodiments of the present invention may include a system for propelling any type of projectile.

Figure 1B:
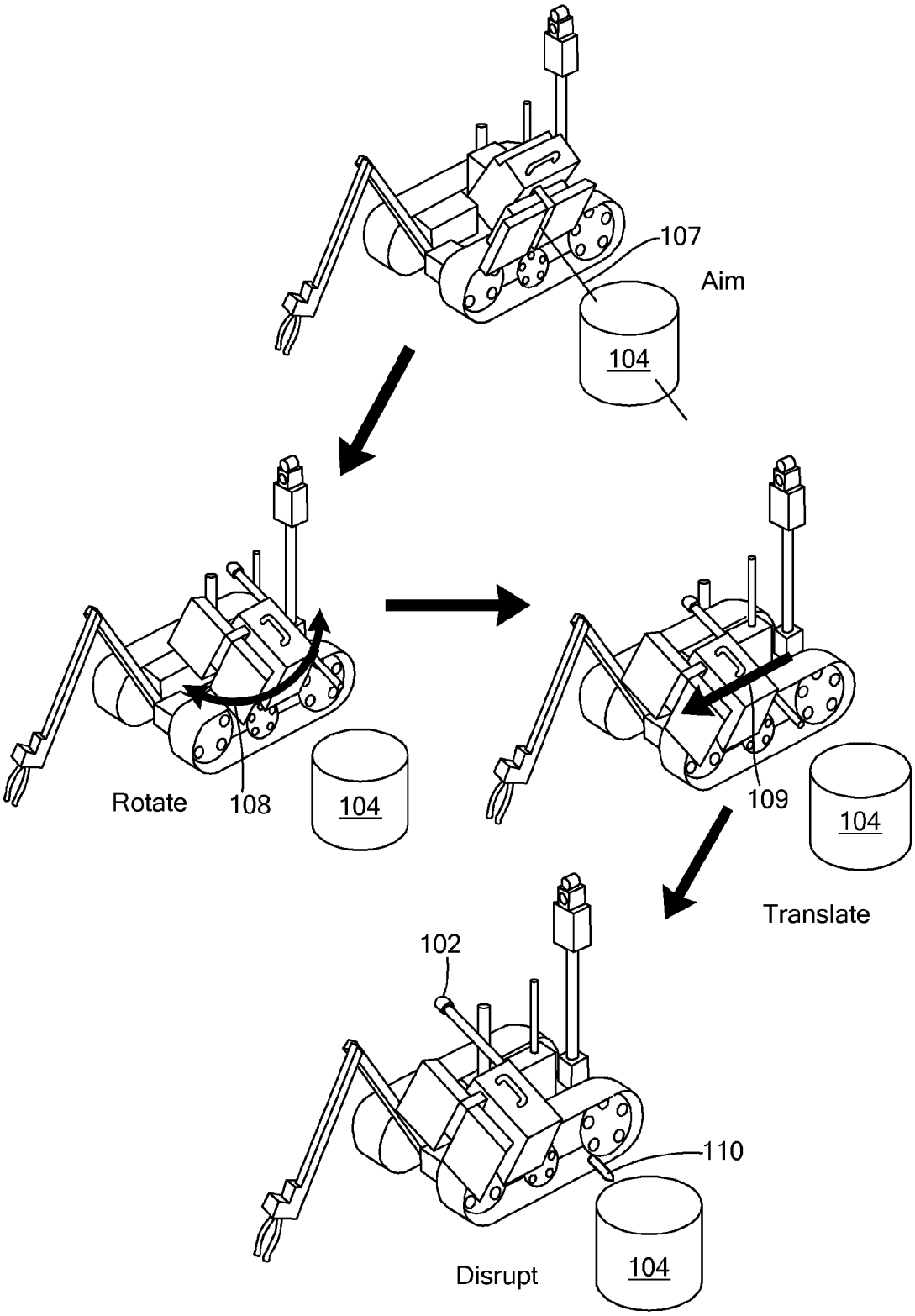

FIG. 1 further demonstrates how disruptor 101 may be positioned in accordance with various embodiment of the present invention. As shown in this figure, positioning disruptor 101 may include rotating the disruptor, or a platform upon which the disruptor is located, in a direction generally indicated by reference arrow 108. Additionally, the disruptor or the platform housing the disruptor may be translated in a direction parallel to the forward direction of the disruptor assembly, generally indicated by reference arrow 109. The platform may be in the form of a multi-axis pedestal that is capable of precisely positioning both the disruptor and the inspection system (including the source and detectors). In such an embodiment, the inspection system and or the disruptor may be provided with a quick disconnect system for easily attaching or removing the system from the robot.

In some embodiments of the present invention, the disruptor may alternatively or additionally be repositioned with respect to the object through movement of the robot 100. Furthermore, the disruptor may be moved in a direction having a vertical component, or in any other direction required to disrupt the explosive device in accordance with an identified location of a target and any additional components that might obstruct a pathway between the disruptor and the target.

Figure 2:
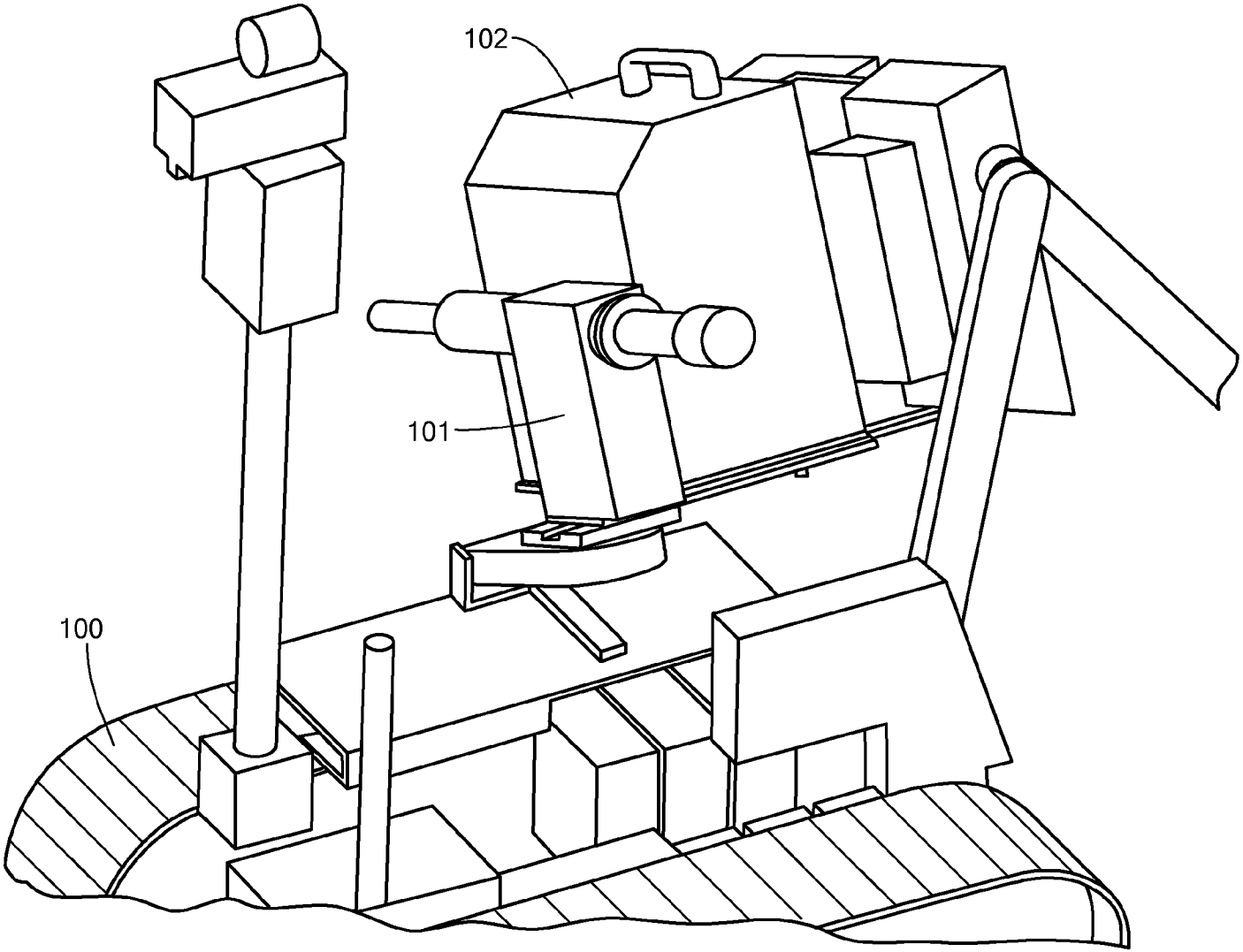
FIG. 2 shows an inspection system and a disruptor located on the robot illustrated in FIG. 1.

FIG. 2 shows the inspection system and the disruptor located on the robot illustrated in FIG. 1. As noted above, the inspection system 102 may be an x-ray inspection system and may be configured to produce images of the internal components of the object being scanned. Inspection system 102 and disruptor 101 may be coupled to the robot to co-locate a pencil beam of radiation produced by the source of inspection system 102 with disruptor 101. The inspection system and the disruptor may be coupled to the robot via a platform connected to an actuator capable of rotating the platform about multiple axes and capable of translating the platform vertically and horizontally. Accordingly, once the inspection system is used to inspect the object and a target is identified, the inspection system may be moved and the disruptor may be aimed based on an identified location of the target. In some embodiments, the source of penetrating radiation in the inspection system has a coordinated position on the robot with respect to the disruptor which means that when the position and orientation of one is known, the position and orientation of the other can be calculated. Moving the disruptor so that it is properly aimed at the target may include translations and rotations of the disruptor in coordination with or independent of the translation and rotation of the robot.

Aiming the disruptor is accomplished using a software interface where the user is able to use a scatter image produced by the inspection system and specify a target location on the image. The software reads data from the image file, which may include global coordinates, to provide the angular theta and phi to the mechanical aiming mechanism to sight the shot of the disruptor device. Once the disruptor is properly positioned and aimed, the disruptor may be activated to disrupt the target and consequently disarm the explosive device.

The control, interface, and display of data for the inspection system may be accomplished using a computer program product in conjunction with a computer system. Such implementations may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over a network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Windows® based software and may be achieved through a Common Control Unit (CCU) operating the robot. Accordingly, an operator may control the robot, inspection system, and the disruptor with a single control interface. The system may be automated so that once an operator identifies and selects a disruption target, the positioning controls of the disruptor and the robot automatically aims the disruptor at the object for disruption of the target selected on the image of the object.

Figure 3:
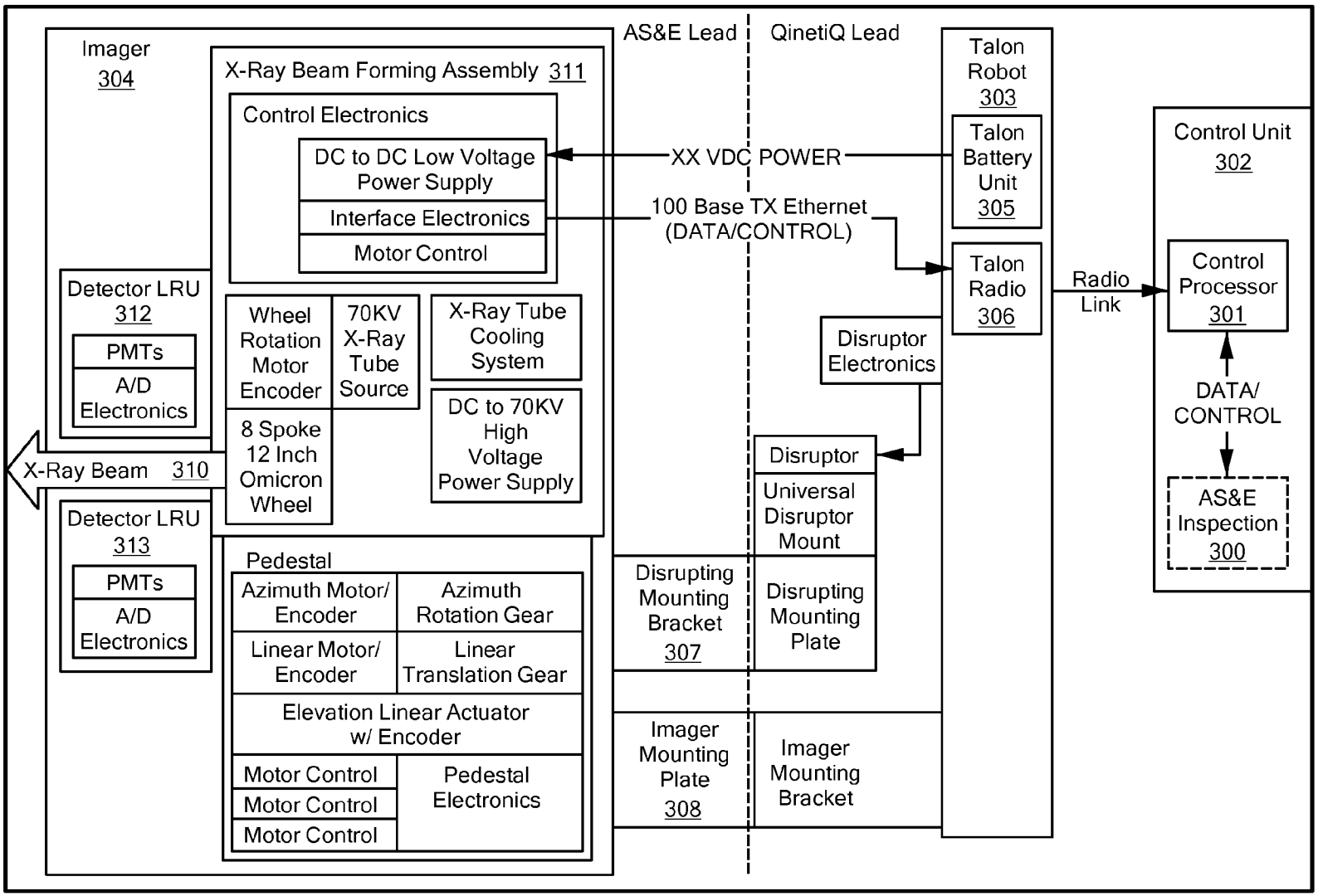
FIG. 3 shows a block diagram of the disruptor system in accordance with various embodiments of the present invention.

FIG. 3 shows a block diagram of the disruptor guidance system in accordance with various embodiments of the present invention. As demonstrated in this figure, the imager or inspection system 304 may be configured for direct integration with the systems of an existing robot. The system may directly interface with the robots power source, internet and data controls 306, and mounting mechanisms 307 and 308. Furthermore, the controls system 300 of the inspection system may be integrated into the control processor in the CCU of the robot 303.

As demonstrated by the block diagram of FIG. 3, the inspection system 304 may be positioned on pedestal 309 having a full range of degrees of translational and rotational freedom as provided to target an object with an x-ray beam of radiation 310 produced by a beam forming assembly 311. Once the radiation is scattered by the object and detected by detectors 312 and 313, the disruptor may be positioned for disruption in accordance with various embodiments of the present invention.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A system for guiding a disruptor robot in disruption of an explosive device, the system comprising:

a source of penetrating radiation, having a coordinated position on the robot with respect to a disruptor coupled to the robot;

at least one detector for detecting radiation produced by the source and scattered by the explosive device;

an analyzer for producing an image of the explosive device including a disruption target of the explosive device; and a controller for positioning the disruptor with respect to the explosive device so that the disruptor is aimed at the disruption target.

2. The system according to claim 1, wherein positioning the disruptor comprises positioning the robot.

3. The system according to claim 1, wherein the radiation is x-ray radiation.

4. The system according to claim 1, wherein the radiation scattered by the explosive device includes backscattered radiation.

5. The system according to claim 1, wherein the image is a 3-dimensional image.

6. The system according to claim 1, wherein the source includes a collimator adapted to collimate the penetrating radiation into a pencil beam of penetrating radiation.

7. The system according to claim 6, wherein the source includes a scanner adapted to displace the pencil beam of penetrating radiation.

8. The guided system for the disruption of an explosive device, the system comprising, a mobile robot;

a disruptor coupled to the robot;

an imaging system coupled to the robot in coordination with the disruptor, the imaging system including:

a source of penetrating radiation, the source having a coordinated position on the robot with respect to the disruptor, at least one detector for detecting radiation produced by the source and scattered by the explosive device, and an analyzer for producing an image of the explosive device including a disruption target for the explosive device; and a controller for positioning the disruptor with respect to the explosive device so that the disruptor is aimed substantially at the disruption target.

9. The system according to claim 8, wherein positioning the disruptor comprises positioning the robot.

10. A method of guiding a disruptor robot in disruption of an explosive device, the method comprising, inspecting the explosive device with an inspection system coupled to the robot in coordination with a disruptor, wherein inspecting the explosive device includes, irradiating the explosive device with radiation produced by a source of the inspection system, detecting, with at least one detector of the inspection system radiation produced by the source and scattered by the explosive device, generating detector output signals based on radiation received by the at least one detector, and characterizing the explosive device on the basis of the detector output signals;

identifying a disruption target of the explosive device based on the characterization of the explosive device; and positioning the disruptor of the robot with respect to the explosive device so that the disruptor is aimed substantially at the disruption target.

11. The method according to claim 10, wherein irradiating the explosive device includes scanning the radiation source across the explosive device.

12. The method according to claim 10, wherein characterizing the explosive device includes creating an image of the explosive device based on the detector output signals.

13. The method according to claim 10, wherein positioning the disruptor comprises positioning the robot.

* * * * *